United States Patent [19]

Chen

[11] Patent Number: 4,841,746

[45] Date of Patent: Jun. 27, 1989

[54] MULTIPLE TIER RING WITH INTERCHANGEABLE SETTINGS

[76] Inventor: Felix Y. C. Chen, P.O. Box 58498, Dallas, Tex. 75258

[21] Appl. No.: 94,456

[22] Filed: Sep. 9, 1987

[51] Int. Cl.[4] ..... A44C 9/00

[52] U.S. Cl. ..... 63/15; 63/31

[58] Field of Search ..... 63/31, 15, 29 R, 30, 63/26; D11/27, 35

[56] References Cited

U.S. PATENT DOCUMENTS

| | | | |
|---|---|---|---|
| D. 257,018 | 9/1980 | Barr | 63/29 R X |
| 1,060,631 | 5/1913 | Rich et al. | 63/15 X |
| 1,672,355 | 6/1928 | Ullman | 63/15 X |
| 3,805,549 | 4/1974 | Nielsen | 63/15 X |
| 4,052,864 | 10/1977 | Hofsaess | 63/31 |

FOREIGN PATENT DOCUMENTS

| | | | |
|---|---|---|---|
| 509909 | 11/1920 | France | 63/31 |
| 257313 | 2/1928 | Italy | 63/31 |
| 453976 | 9/1936 | United Kingdom | 63/29 R |
| 1001303 | 8/1965 | United Kingdom | 63/31 |

OTHER PUBLICATIONS

Publication of the American Diamond Jewelry Competition, 1973, Copy in cl. 63/31.

*Primary Examiner*—James R. Brittain
*Attorney, Agent, or Firm*—Dennis T. Griggs

[57] ABSTRACT

A finger ring is provided with ringlets mounted in a multiple tier arrangement. The ringlets are rotatably mounted about a removable axle. Each ringlet is coupled to the axle by a ball bearing assembly which is secured to the inside diameter of each ringlet. According to this rotary mounting arrangement, the center of gravity of each ringlet is offset with respect to its axis of rotation about the axle. Momentum imparted to each ringlet causes the ringlets to undergo separate and independent rotary movements, with the relative rates of rotation depending upon relative mass differences of the respective ringlets.

1 Claim, 1 Drawing Sheet

MULTIPLE TIER RING WITH INTERCHANGEABLE SETTINGS

FIELD OF THE INVENTION

This invention relates generally to articles of personal adornment, and in particular to a finger ring having a movable setting.

BACKGROUND OF THE INVENTION

In the art of jewelry design, a finger band of precious metal such as gold or silver provides a setting onto which gemstones are mounted. Artistic techniques are employed to arrange precious metals and gems in an aesthetically pleasing design. The luster and color of the underlying precious metal is carefully selected to complement the ornamental features of the gemstones. The band of precious metal may be engraved or otherwise finished to provide an attractive background for the gemstones. In such arrangements, the gemstones are carefully arranged to direct refracted light toward an observer in response to movements of the hand. This produces a colorful effect which enhances the ornamental value of the ring.

DESCRIPTION OF THE PRIOR ART

It is known in the art of jewelry design to provide a finger ring having a movable setting onto which gemstones may be mounted and displayed. The object of such an arrangement is to achieve an artistic, ornamental movement of the gemstones in response to ordinary hand movements. In such arrangements, the mechanically movable setting is typically mounted for free movement or oscillation with respect to the finger ring. Upon the slightest hand movement, the mobile setting is set in motion and continues to move or oscillate for a short while after hand movement has ceased. The artistic imagery of such an arrangement gives the appearance of animation and provides an attractive display of colors under appropriate lighting conditions.

In conventional finger rings having fixed gem settings as well as mobile gem settings, no means have been provided for arranging different settings in a single ring according to the user's preference. Such preferences have been satisfied by maintaining a variety of rings, with each separate ring being styled to be complementary with wardrobe color variations and formality requirements of specific social engagements, for example cocktail parties, banquets, theater and the like. Accordingly, there is a continuing interest in improving the ornamental features and versatility of finger rings.

OBJECTS OF THE INVENTION

A general object of the present invention is to provide an improved finger ring having a mechanically movable jewelry setting which, in response to ordinary hand movements, creates a dynamic, aesthetically pleasing display.

Another object of the present invention is to provide a finger ring having a movable jewelry setting which can be easily interchanged with a jewelry setting of a different design to accommodate personal preference, wardrobe variations and the like.

Yet another object of the present invention is to provide a finger ring having a movable jewelry setting in which two or more articles of adornment can be mounted in an aesthetically pleasing, multiple tier arrangement.

A related object of the present invention is to provide a finger ring having a movable jewelry setting on which two or more jewelry settings are separately movable about a common axis for creating a dynamic display of gemstone colors.

SUMMARY OF THE INVENTION

The foregoing objects are achieved according to the present invention in a finger ring having one or more jewelry settings rotatably mounted about a removable axle. The individual jewelry settings are independently movable in rotation about the axle in response to ordinary hand movements.

According to the preferred embodiment, a boss is formed on the finger band of a ring and a threaded pocket is formed within the boss. A threaded axle secured within the pocket of the boss supports one or more ringlets for free rotation. The ringlets are coupled to the axle by ball bearing assemblies which are secured to the inside diameter of the ringlets. According to this mounting arrangement, the center of gravity of each ringlet is offset with respect to its axis of rotation about the axle. As a result of the offset relationship, momentum imparted to each ringlet causes the ringlets to undergo separate and independent rotary movements, with the relative rates of rotation depending upon relative mass differences of the respective ringlets. The differential rates of rotation of multiple jewelry settings create a scintillating display of iridescent gemstone colors.

The threaded axle is provided with an ornamental end cap which can be manually twisted to remove the axle for substituting various jewelry settings according to user preference.

Other features and advantages of the present invention will be recognized by those skilled in the art upon reading the following description of a preferred embodiment with reference to the accompanying drawings.

DETAILED DESCRIPTION OF THE PREFERRED EMBODIMENT

Figure 1:
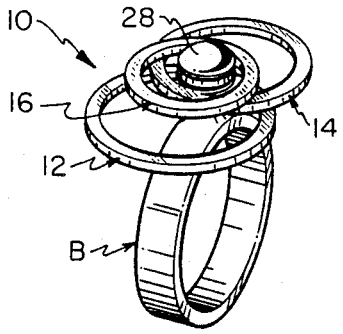
FIG. 1 is a perspective view of a finger ring having a movable jewelry setting embodied in a multiple tier arrangement.

In the description which follows, like parts are indicated by the same reference numerals throughout the specification and drawings, respectively. The drawing figures are not necessarily to scale and the proportions of certain parts have been exaggerated to clarify certain features of the invention.

Referring now to FIG. 1, a finger ring 10 includes a band B of precious metal such as gold or silver on which separate jewelry settings are mounted for independent movement and rotation in response to ordinary hand movements. In the preferred embodiment as shown in FIG. 1, the separate jewelry settings are ringlets 12, 14 and 16 which are mounted onto an axle 18 for rotation about an axis A.

Figure 2:
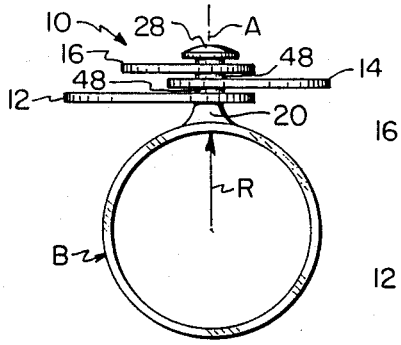
FIG. 2 is a side elevation view thereof.
Figure 3:
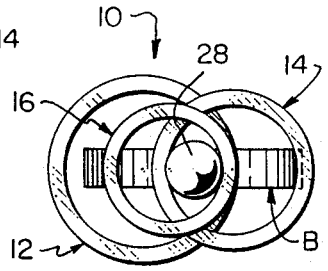
FIG. 3 is a top plan view thereof.

Referring now to FIG. 2, a boss 20 is formed onto the external surface of the curved finger band B and projects externally thereof, thereby providing clearance for rotation of ringlet 12. The boss 20 is provided with a threaded pocket 22 which extends substantially in alignment with the radius R of curvature of the finger band B. The axle 18 is provided with male threads 24, and the boss body portion within the pocket 22 is provided with matching female threads. According to this arrangement, the axle 18 is releasably secured within the pocket of the boss by threaded engagement of the matching male and female threads. The boss 20 is further provided with a bearing surface in the form of an annular face 26 which borders the threaded pocket 22.

Figure 4:
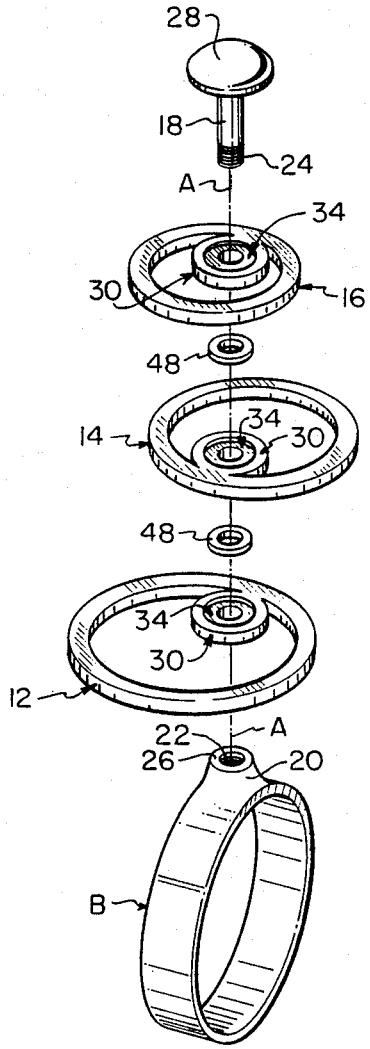
FIG. 4 is an exploded perspective view thereof.

Referring now to FIG. 4, the axle 18 projects externally of the boss 20, and establishes a rotational axis A which is substantially aligned with the radius R of curvature of the band B. An ornamental end cap 28 is secured to the distal end of the axle 18. The end cap 28 can be manually twisted to remove the axle 18 from the pocket 22 for substituting various jewelry settings according to user preference.

Figure 5:
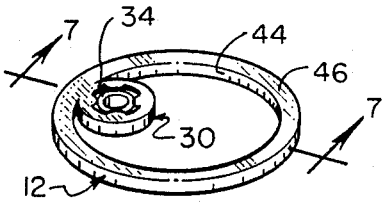
FIG. 5 is a perspective, top side view of a ringlet which forms a part of the multiple tier arrangement shown in FIG. 1.
Figure 6:
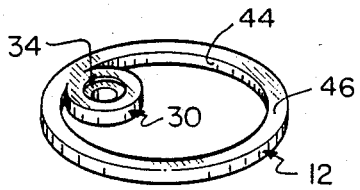
FIG. 6 is a perspective, bottom view of the ringlet shown in FIG. 5.
Figure 8:
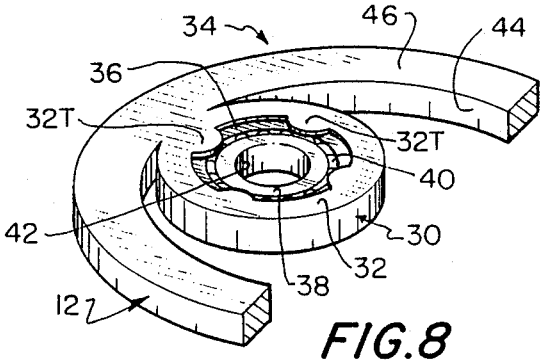

The ringlets 12, 14 and 16 are mounted about the axle 18 for free rotation. Each ringlet is mounted for rotation onto the axle 18 by a rotary coupling member 30. Referring now to FIGS. 5, 6 and 8, the rotary coupling member includes a housing 32 in which a roller ball bearing assembly 34 is mounted. The roller bearing assembly 34 includes an outer sleeve 36 received within the housing, an inner sleeve 38 coaxially mounted onto the axle 18 and concentrically disposed within the outer sleeve 36, and a circular array of roller bearings 40 movably coupling the outer sleeve 36 for rotation relative to the inner sleeve 38. The inner sleeve 38 is provided with a bore 42 which is dimensioned for a sliding, frictional fit about the axle 18. The outer sleeve 36 is confined within the housing 32 by housing tabs 32T.

Figure 7:
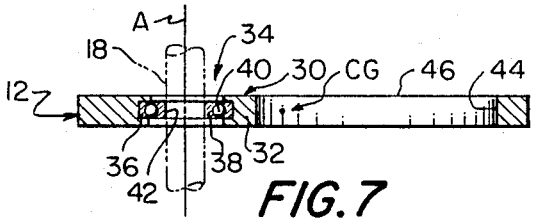
FIG. 7 is a sectional view of the ringlet of FIG. 5 taken along the lines 7—7; and, FIG. 8 is an enlarged perspective view, partly broken away, which illustrates a ball bearing assembly and its associated ringlet mounting structure.

According to an important feature of the invention, the bearing assembly housing 32 is attached directly onto the inside diameter surface 44 of each ringlet. According to this arrangement, the center of gravity CG (FIG. 7) of each ringlet is offset with respect to the rotational axis A. Because of this offset, unbalance mounting arrangement, momentum imparted to the ringlet causes it to rotate about the axle 18.

In a multiple tier arrangement as illustrated in FIG. 1 in which two or more ringlets having unequal masses are mounted for rotation about the axle 18, momentum imparted to each ringlet, for example in response to hand movements, causes the ringlets to undergo separate and independent rotary movements, with the relative rates of rotation being proportional to relative mass differences of the respective ringlets. In the preferred embodiment as illustrated in FIG. 1, the ringlets have unequal diameters, and proportionally unequal masses.

Referring again to FIG. 8, the upper surface 46 of the ringlet 12 serves as a jewelry setting on which precious gems can be mounted. The differential rates of rotation associated with a multiple tier ringlet arrangement as shown in FIG. 1 creates a scintillating display of iridescent colors as light is refracted by gemstones mounted onto the jewelry setting surface 46 of each ringlet.

Referring now to FIG. 4, the ringlets 12, 14 and 16 are mounted in a vertically stacked, multiple tier arrangement with adjacent ringlets being separated by a spacer ring 48. The ringlets are sufficiently separated by the spacer rings 48 along the axle 18 to permit free rotation of each ringlet. The amount of axial travel of each ringlet along the axle is limited by engagement of the roller bearing assembly 34 against the bearing surface 26 at one end of the axle 18, and by the end cap 28 at the other end of the axle.

The ringlets 12, 14 and 16, along with the spacer rings 48, are confined onto the axle 18, but can be removed for a substitution of ringlets having a different design or a gemstone arrangement, as desired. Removal and replacement of ringlets can be carried out by grasping the ornamental end cap 28 and twisting it to remove the axle 18 from the pocket 22, and thereafter remove the mounted ringlets for substitution as desired.

Although the invention has been described with reference to a specific embodiment, and with reference to a particular multiple tier ringlet arrangement, the foregoing description is not intended to be construed in a limiting sense. Various modifications of the disclosed embodiment as well as alternative applications of the invention will be suggested to persons skilled in the art by the foregoing specification and illustrations. It is therefore contemplated that the appended claims will cover any such modifications or embodiments that fall within the true scope of the invention.

What is claimed is:

1. A finger ring comprising, in combination:

a curved finger band;

a boss formed on said finger band and projecting externally thereof, said boss having a pocket disposed substantially in alignment with the radius of curvature of said finger band and having a bearing surface bordering said pocket;

an axle having a first end portion disposed within said pocket, a body portion projecting externally of said boss substantially in alignment with said radius of curvature, and an end cap secured onto said externally projecting body portion;

fastener means carried by said boss and axle, respectively, said fastener means being disposed in releasable, interlocking engagement within said pocket;

said fastener means comprising male threads formed on the first end portion of said axle and matching female threads formed on said boss body portion within said pocket, wherein said axle is releasably secured to said boss by threaded engagement of said male and female threads;

a ringlet mounted onto said axle body portion for axial movement and rotation with respect thereto, with axial travel of said ringlet along said body portion being limited by said boss bearing surface and said end cap;

a rotary coupling member interposed between said axle and said ringlet, said rotary coupling member positioning said ringlet relative to said axle whereby the center of gravity of said ringlet is offset with respect to its axis of rotation about said axle;

said rotary coupling member including a bearing housing rigidly attached to the inside diameter surface of said ringlet, and a roller bearing assembly mounted in said bearing housing, said roller bearing assembly including an outer sleeve received within said housing, an inner sleeve mounted on said axle and concentrically disposed within said outer sleeve, and roller bearings movably coupling said outer sleeve for rotation relative to said inner sleeve; and, said bearing housing being substantially cylindrical and having a radially projecting tab overlapping said outer sleeve for retaining said roller bearing assembly within said housing.

* * * * *